United States Patent [19]

Meggs

[11] Patent Number: 4,619,456

[45] Date of Patent: Oct. 28, 1986

[54] MAGNETIC RETENTION OF HOCKEY GOALS

[75] Inventor: Dennis Meggs, Waterloo, Canada

[73] Assignee: Dennis Meggs Enterprises Limited, Ayr, Canada

[21] Appl. No.: 599,287

[22] Filed: Apr. 11, 1984

[30] Foreign Application Priority Data

Apr. 26, 1983 [GB] United Kingdom ..... 8311312

[51] Int. Cl.[4] ..... A63B 63/00

[52] U.S. Cl. ..... 273/127 B; 335/296; 403/DIG. 1

[58] Field of Search ..... 273/127 B, 127 R, 400, 273/1 B, 181 A, 181 R, 181 J, 181 K, 181 F, 26 A; 403/DIG. 1, DIG. 4; 335/296, 286, 290, 285; 340/551; 24/201 B, 303; 294/65.5

[56] References Cited

U.S. PATENT DOCUMENTS

| | | | |
|---|---|---|---|
| 2,077,343 | 4/1937 | Oakes et al. | 273/127 B |
| 2,525,304 | 10/1950 | Lindsey | 273/127 B |
| 2,623,256 | 12/1952 | Feibelman | 24/303 |
| 3,513,422 | 5/1970 | Watson et al. | 335/296 |
| 3,862,756 | 1/1975 | Selliken | 273/25 |
| 3,979,120 | 9/1976 | Dietrich | 273/127 B |
| 4,420,158 | 12/1983 | Klouk et al. | 273/127 B |
| 4,449,708 | 9/1948 | Lindsey | 273/127 B |

FOREIGN PATENT DOCUMENTS

| | | | |
|---|---|---|---|
| 1426635 | 3/1965 | France | 335/296 |

*Primary Examiner*—Richard C. Pinkham
*Assistant Examiner*—T. Brown
*Attorney, Agent, or Firm*—Sim & McBurney

[57] ABSTRACT

A cylindrical canister is used within the bottom of a hockey goal post to retain the post in place against a keeper. A magnetic arrangement in the canister, possibly involving the post itself, draws the post downwardly against a keeper, and the keeper has a frustoconical central portion which requires the post to ride up and over it in order to be dislodged by a lateral force.

15 Claims, 11 Drawing Figures

FIG. 1
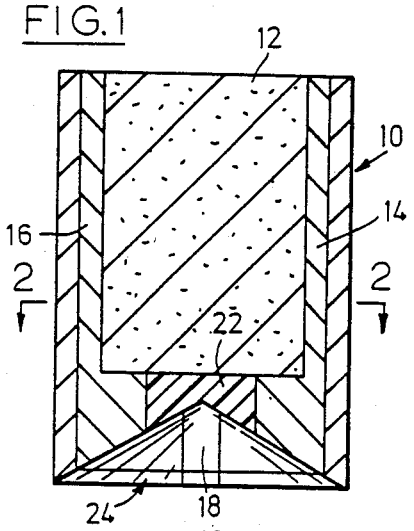
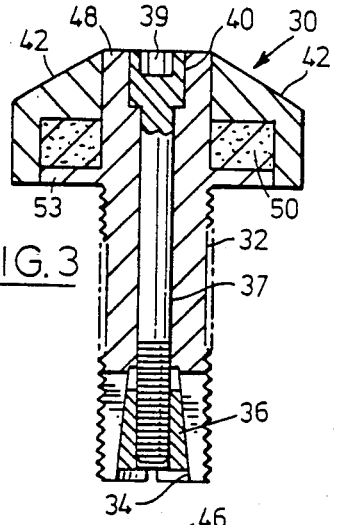
FIG. 3
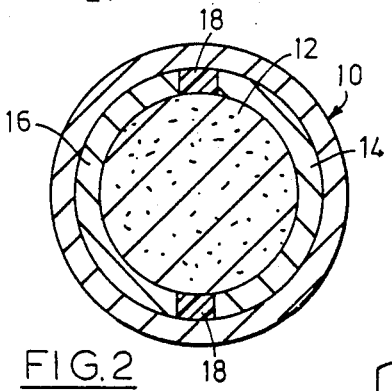
FIG. 2
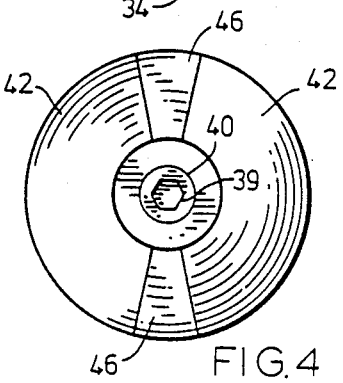
FIG. 4
FIG. 5
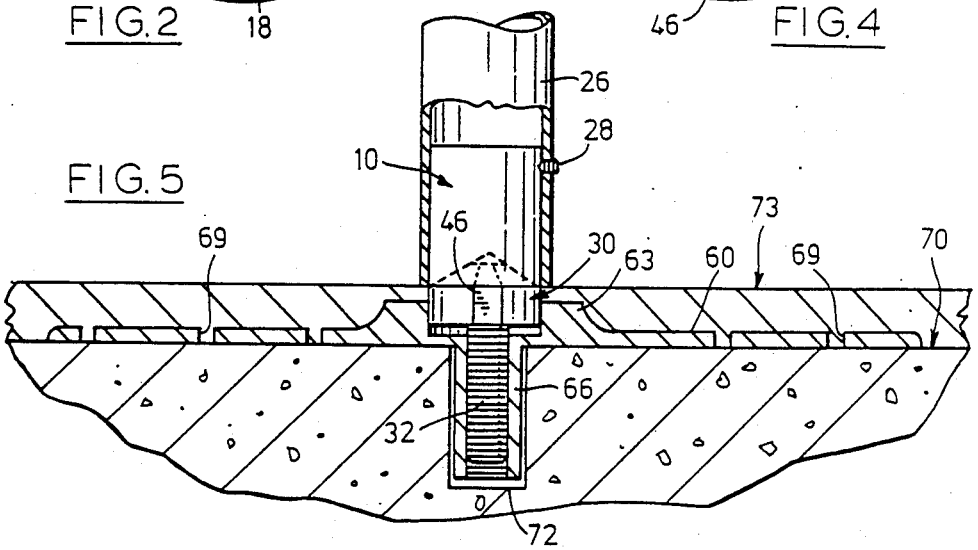

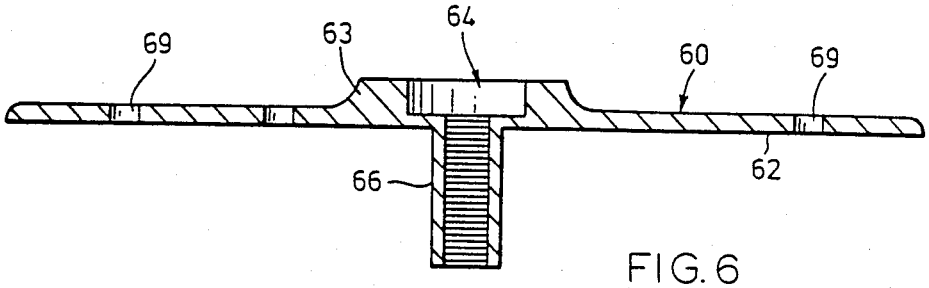
FIG. 6
FIG. 7
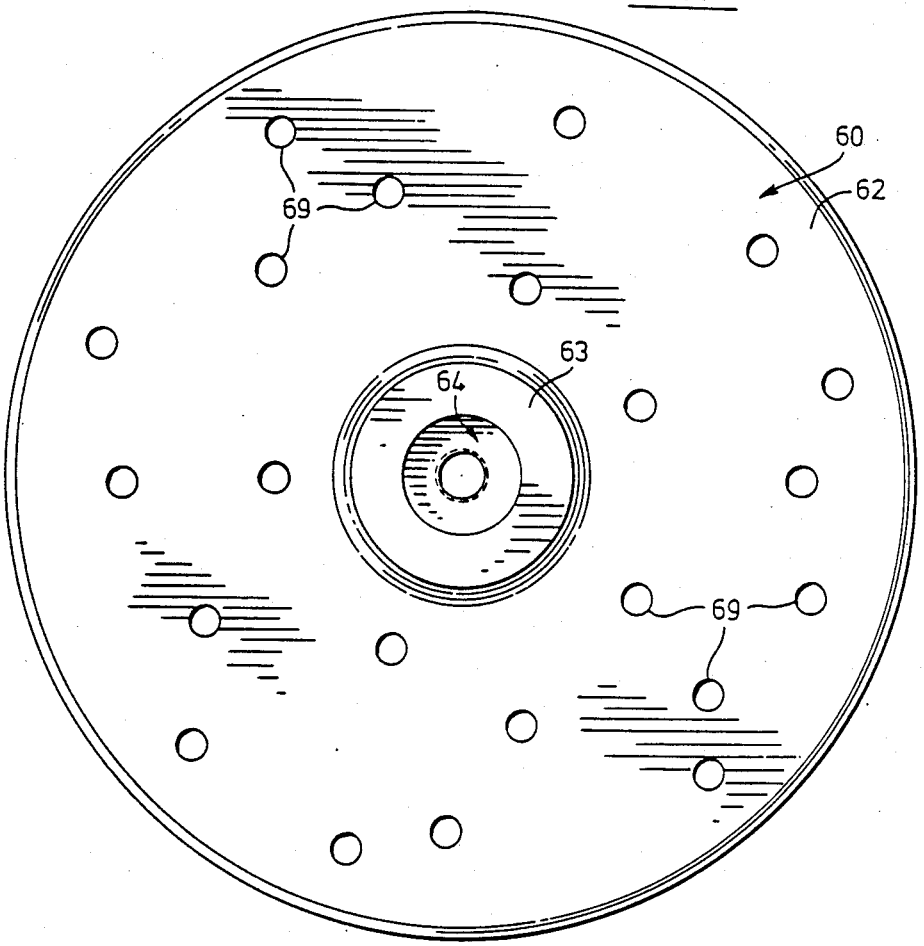

MAGNETIC RETENTION OF HOCKEY GOALS

This invention relates generally to hockey goal accessories, and has to do particularly with the design of a retaining means which is capable of magnetically retaining a hockey goal in place on the ice.

BACKGROUND OF THIS INVENTION

In the game of ice hockey, a goal is used which typically measures about 72 inches across, about 48 inches high, and about 37 inches deep. Vertical goal posts rise from the forward side corners, and the lower rear outline of the goal is generally defined by two curves having spaced-apart centres of curvature. The two curves generally define a kidney shape when seen in plan.

In simpler hockey facilities, a hockey goal is merely positioned on the ice, and maintains its position due to its weight. However, any substantial impact from a player will often move the hockey goal. When that happens, the game must be suspended, and the hockey goal put back into a position which is marked in colour under the ice surface.

Other installations have a removable stub post sticking upwardly out of the ice at the positions of the forward side goal posts, and the goal posts are hollow with open bottom ends, so that they can fit over the stub posts. When the ice is to be used for activities other than hockey games, the goal is removed, and the stub posts are removed from the ice.

The use of these stub posts registering within the forward side goal posts produces a hockey goal which is very firmly anchored in position. When a hockey player collides with the goal during play, the full force of the impact is absorbed by the player's body, and this often results in broken or dislocated shoulders and other damage. It is well understood that, if the hockey goal were retained in place by some means which allowed a sufficient impact to dislodge the goal from position, then the hockey player's body would not be required to absorb as much of the energy of impact, and injuries could be reduced.

GENERAL DESCRIPTION OF THIS INVENTION

Accordingly, this invention seeks to provide a magnetic retention means for hockey goals, which is capable of retaining the goal in place against light impact, but which allows the goal to be dislodged from position if the impact is above a certain threshold. An aspect of a preferred embodiment of this invention is the provision of magnetic retention means for hockey goals which is capable of simple adjustment in terms of the holding power retaining the hockey goal in place. By this provision, the threshold of impact energy necessary to dislodge the hockey goal from position can be adjusted for the size of the players. For example, children weighing less than 120 lbs. would require a lower retention force than would be used for adults.

More particularly, this invention provides a cylindrical canister for use within a pipe to retain the pipe in place against a keeper, the canister comprising:

means defining a ferromagnetic flux path within the canister and adapted to contact the keeper, the flux path being defined by a ferromagnetic core within a radially polarized magnetic layer, the magnetic layer being surrounded by a ferromagnetic sleeve, and means for sustaining a closed magnetic circuit passing through the means defining said ferromagnetic flux path and the keeper.

In addition, this invention provides the combination of a hollow hockey goal post in the form of a ferromagnetic pipe with an open bottom end, a cylindrical canister within the pipe, and a keeper secured to the ice. The canister has a solid ferromagnetic core encased by a radially polarized magnetic sheath, the latter being encased by a ferromagnetic sleeve fitting closely within the pipe. The keeper has a raised central portion adapted to contact an end of the core, a lower peripheral portion adapted to contact the ferromagnetic pipe, and a frusto-conical portion between the central and peripheral portions.

Finally, this invention provides a method of removably securing a hollow pipe in place against a keeper, the keeper having a raised central portion, a lower peripheral portion, and a frusto-conical portion between the central and peripheral portions. The method includes first affixing within the pipe a ferromagnetic core which is adapted to contact the central portion of the keeper while the pipe contacts the peripheral portion, and then sustaining a magnetic flux circuit in which the flux lines connect the core, the keeper and the pipe.

GENERAL DESCRIPTION OF THE DRAWINGS

Two embodiments of this invention are illustrated in the accompanying drawings, in which like numerals denote like parts throughout the several views, and in which FIG. 1 is an axial sectional view through the first embodiment of a "canister" intended to be fixed inside the bottom of a forward post of the hockey goal;

FIG. 2 is a sectional view taken at the line 2—2 in FIG. 1;

FIG. 3 is an axial sectional view of a base unit adapted to be located substantially at the ice surface;

FIG. 4 is a plan view looking axially down on the base unit of FIG. 3;

FIG. 5 is a sectional view through the assembled structure, showing a portion of the hockey goal and the items illustrated in FIGS. 1 and 3;

FIG. 6 is an axial sectional view through a floor plate for use with this invention;

FIG. 7 is a plan view of the floor plate of FIG. 6;

DETAILED DESCRIPTION OF THE DRAWINGS

Figure 9:
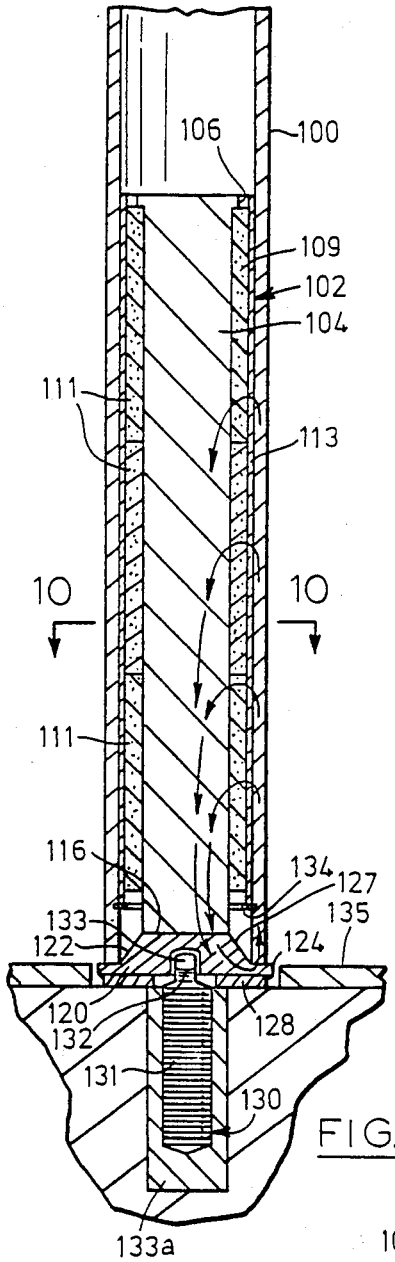
FIG. 9 is an axial sectional view through the canister of FIG. 8 and through a keeper with which it interacts.

Attention is first directed to FIGS. 1 and 2, which illustrate a canister 10 which consists of several components. Centrally within the canister is located a cylindrical magnet 12 which is cross-polarized. This means that the flux lines do not run in the axial direction within the cylindrical magnet, but rather traverse the magnet in a direction transverse to the cylindrical axis. This will mean that the region along one portion of the side wall of the magnet will be a north pole, and the diametrically opposite location will be the south pole. Immediately surrounding the magnet 12 are two ferromagnetic caps 14 and 16, each of which is somewhat less than semi-cyclindrical as can be seen in FIG. 2. The caps 14 and 16 are separated from each other by aluminum inserts 18. Surrounding the caps 14 and 16 and the inserts 18 is an aluminum cylinder 20.

As can be seen in FIG. 1, each cap 14 and 16 is formed in such a way as to extend partly under the magnet 12. Between these portions of the caps 14 and 16 is a space which is filled by epoxy or other non-magnetic material 22.

As also seen in FIG. 1, the lower portions of the aluminum cylinder 20, the caps 14 and 16, and the epoxy 22 are shaped to define a conical recess 24, the purpose of which will become clear subsequently.

As can be seen in FIG. 5, the canister 10 is intended to be inserted into the open bottom end of a goal post 26, and to be locked into place with a set screw or equivalent member 28.

Attention is now directed to FIG. 3, which shows the base unit 30 provided by this invention. The base unit 30 is a composite member which includes a threaded shaft 32, having a tapered recess 34 in the lower end, and being cut along axial planes at the lower end in such a way that the remaining portions are flexible and can flex outwardly when a wedge member 36 is drawn upwardly into the recess 34 by a screw 37 turned from its upper end by virtue of a hexagonal opening 39 in the head 40. By causing the lower slit portions surrounding the tapered recess 34 to flare outwardly after the shaft 32 has been threaded into an appropriately threaded bore (shortly to be disclosed), the shaft 32 can be jammed into place in order to lock the base unit 30 into a desired orientation.

At the upper end, the base unit 30 incorporates two steel shoulder members 42, each of which extends something less than 180° around the circumference of the head of the base unit 30, as can be seen in FIG. 4. Between the non-contacting edges of the shoulder members 42 may be provided epoxy or aluminum inserts 46. The shaft 32 is integral with a boss 48 which extends upwardly between the shoulder members 42, as can be seen in FIG. 4. An annular, cross-polarized magnet 50 is provided between the shoulder members 42, the boss 48, and a horizontally projecting flange 53 which encloses the magnet 50 on its underside.

The shaft 32, boss 48 and flange 53 are integral, and can be of any suitable non-ferromagnetic metal such as aluminum or brass.

Attention is now directed to FIGS. 6 and 7 which show the floor plate 60 to include a flange 62 of circular configuration, an upstanding annular boss 63 enclosing a recess 64 adapted snugly to receive the head of the base member 30 as seen in FIG. 5, and a downwardly extending, integral tailpiece 66 which is bored and internally threaded to receive the shaft 32. The fit between the internal threads of the tailpiece 66 and the threads of the shaft 32 is loose enough to allow the base member 30 to be hand rotated easily into place, but snug enough to permit the base member 30 to be locked into place by rotating the screw 37 with respect to the base member 30, thus drawing the wedge 36 up within the tapered recess 34, thus forcing the separated lower portions of the shaft 32 (separated by slits or slots) outwardly into mechanical engagement with the sides of the threaded bore within the tailpiece 66.

As seen in FIG. 7, the flange 62 is provided with a plurality of random holes 69.

Turning to FIG. 5, there is shown the concrete floor 70 on which ice is normally poured, the floor having a recess 72 at the locations where goal posts are intended to be located.

The floor plate 60 is arranged with the tailpiece 66 extending into the recess 72, and this is done before the ice is laid over the concrete floor 70. During the laying of the ice, a plug would be inserted into the recess 64 defined by the floor plate 60, to allow the level of the ice to rise above that of the annular flange 63, as can be seen in FIG. 5. Typically, the thickness of the floor plate at the flange 63 would be approximately $\frac{5}{8}''$, whereas the ice thickness could be about $\frac{3}{4}''$ or a bit more. Then, the plug is removed from the recess 64, and the base unit 30 is hand threaded into place, while there is no interference or mechanical tension between the wedge 36 and the tapered recess 34. Once the base unit 30 is located so that the upper outer edge of the shoulder members 42 are approximately even with the upper surface 73 of the ice (as seen in FIG. 5), and when the orientation of the base unit 30 is correct, the screw 37 is tightened to lock the base unit 30 into that position.

With the canister 10 in position as shown in FIG. 5, held by the set screw 28, a complementary fit occurs between the frusto-conical upper surfaces of the shoulder members 42 and the conical recess 24 at the bottom of the canister 10.

It will be appreciated that, if the shoulder members 42 are in a position such that each one spans across from the cap 14 to the cap 16 (see FIG. 1), then two efficient paths will be provided for the magnetic flux lines seeking to return from one pole of the magnet 12 to the other (it being understood that the caps 14 and 16 are centred on the two pole locations), and the magnetic grip will be at maximum.

However, if one were to hold the canister 10 in place, and gradually rotate the base unit 30, a position would be reached, 90° away from the position first discussed, in which each shoulder member 42 was in full registry with one of the caps 14, but did not bridge across between the caps. This would in effect break the flux path, and would mean that the holding power between the canister 10 and the base unit 30 would be very much weakened, and practically non-existent. By utilizing intermediate positions between these two extremes, the amount of grip holding the hockey goal in place can be finely adjusted.

In place of the construction for the base unit shown in FIGS. 3 and 4, it will be appreciated that the head of the same could be made as a laminate with a plurality of steel inserts in parallel spaced relation from each other, being located in and held firmly by a non-ferromagnetic matrix. The steel inserts would provide a plurality of bridges for the flux lines when they were positioned parallel with the north to south pole of the magnet, i.e. bridging between the caps 14 and 16, but would not contribute to gripping between the canister 10 and the base unit 30 when turned to 90° from that position.

In order to release the hockey goal from the gripping action of this magnetic means, it would be possible to take one of two approaches. The first approach is to reduce the magnetism, and this can be done by providing alternative flux paths between the poles of the magnet, thus not requiring the flux to pass through the base unit 30. This could be done by inserting ferromagnetic plugs through the magnet bridging between the two caps 14 and 16. If a sufficient number of these plugs were provided, most of the magnetic flux could be accommodated in them with little left over to pass through the base unit 30. This would reduce the grip between the canister 10 and the base unit 30.

By varying the number of plugs inserted, the grip between the post and the base unit can be adjusted to accommodate it to the average weight of the players.

Another approach to releasing the hockey, goal from the magnetic grip is to pry the canister 10 upwardly within the goal post, or to pry the entire goal post upwardly from the ice using an appropriately shaped tool with an angulated end. Many possible means of accomplishing this will be apparent to the person skilled in the art.

Attention is now directed to FIGS. 8, 9, 10 and 11, for a description of the second embodiment of this invention.

Figure 8:
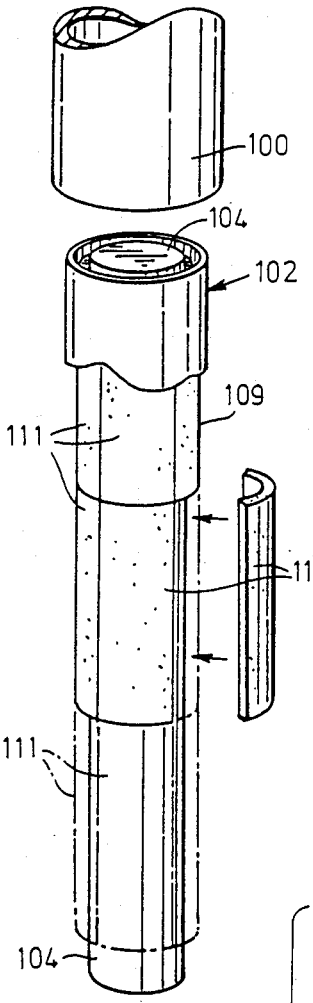
FIG. 8 is a perspective, partly exploded and partly broken-away view of the second embodiment of the "canister" intended to be fixed inside the bottom of a forward post of a hockey goal.

In FIG. 8, the bottom end of a pipe 100 constituting a hockey goal post is illustrated at the top. The pipe 100 has an open bottom end into which a canister 102 can be inserted. The canister 102 includes a central, solid, cylindrical, ferromagnetic core 104, having at the upper end a flange 106 of a slightly enlarged diameter.

Surrounding the ferromagnetic core 104 is a sheath or layer 109 which is permanently magnetized and radially polarized. More specifically, as particularly seen in FIGS. 8 and 10, the magnetic sheath 109 is constituted by a plurality of permanent magnet segments 111. In the particular embodiment illustrated, each segment spans 90° of the periphery of the core 104, and the segments 111 are in three axially adjacent groupings of four each, along the length of the core 104. Thus, twelve segments 111 serve to substantially completely encase the core 104 in a radially polarized permanent magnetic layer or sheath, with the exception of the very end portions, this being discussed subsequently.

As can be seen in FIG. 9, the flange 106 rests above the upper edges of the upper four segments 111.

All of the segments 111 constituting the sheath 109 are surrounded by a ferromagnetic sleeve 113 which is relatively thin compared to the sheath 109 and compared to the pipe 100.

As best seen in FIG. 9, the ferromagnetic core 104 projects downwardly below the sheath 109, and has a flat bottom surface 116 perpendicular to the axis of the core 104. The ferromagnetic sleeve 113 has its lower end terminating somewhat above the surface 116, and the bottom of the lowermost ring of segments 111 is above that level again. In the preferred embodiment, a bonding material such as epoxy or the like is utilized to secure the core 104, the segments 111 and the ferromagnetic sleeve 113 together to form a permanent and solid canister 102, adapted to be inserted into the bottom of the pipe 100.

The sleeve 113 constitutes a close or snug fit within the pipe 100, so that the pipe itself can take part in the flux path shown by the looping arrows in the righthand portion of FIG. 9.

It will be particularly noted that the flux lines pass through a keeper 120, the keeper having a raised central portion 122 adapted to contact the lower surface 116 of the core 104, a lower peripheral portion 124 adapted to contact the pipe 100, and a frusto-conical portion 127 between the central and peripheral portions.

Figure 11:
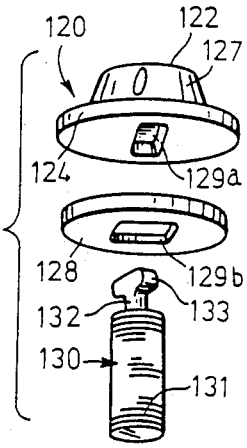
FIG. 11 is an exploded view of the parts of the keeper shown in FIG. 9.
Figure 10:
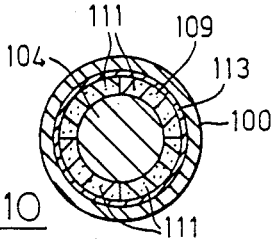
FIG. 10 is a cross-sectional view taken at the line 10—10 in FIG. 9.

As seen in FIGS. 9 and 11, the keeper 120 is fixed to an underlying washer 128, which is slightly smaller in diameter than the peripheral portion 124. The keeper 120 and the washer 128 are welded or otherwise securely fastened together.

FIG. 11 shows that the keeper 120 has a central recess **129*a* in its underside, elongated in the approximate direction of the line-of-sight. The washer 128 has a central opening 129*b*, also elongated and oriented transversely to the recess 129*a***.

A stem member 130 has a threaded shank 131, a neck 132 of reduced diameter and an elongated, hammer-like head 133 which can pass through the opening **129*b* in one orientation only, and likewise can be received in the recess 129*a* in one orientation only. By passing the head 133 through opening 129*b*, then lodging it in the recess 129*a*, then securing the keeper 120 and the washer 128 together in the orientation illustrated in FIG. 11, the head 133 is made captive and cannot be removed. A small tolerance however allows some angulation of the keeper 120 with respect to the stem member, so that the keeper 120 can mate perfectly with and against the bottom surface of the core 104**.

The stem member 130 can be engaged in an appropriate socket or supporting mechanism **133*a* located in a sunken position with respect to the surface 134** of the ice.

In a preferred embodiment of this invention, there would be provided a plurality of keepers similar to keeper 120 shown in FIG. 9, but each keeper would have a different offset between the raised central portion 122 and the lower peripheral portion 124, hence a different slope to the frusto-conical portion 127.

Before explaining the reason for the array of different keepers, attention is directed to FIG. 9 in which it will be noted that a C-clip 134 is located in a groove on the inside surface of the pipe 100, at a location spaced upwardly from the bottom of the pipe. The C-clip 134 provides a lower limit position for the canister 102 within the pipe 100. If desired, set screws at a similar location could be utilized in place of the C-clip 134. The reason for the provision of the C-clip 134 will become clear in what follows.

It will be recalled that one of the purposes of the device disclosed herein is to allow a hockey goal post to be dislodged from its location of securement, upon application of a sufficient force. Looking at FIG. 9, it will be now understood that a lateral force applied against the pipe 100, as when a player collides with the goal during a game of hockey, will firstly shift the pipe 100 over against the bottom of the frusto-conical portion 127 of the keeper 120. In order to move further, however, the goal post must rise up along the frusto-conical portion 127, and in order to do this, the magnetic attraction between the core 104 and the keeper 120 must be overcome. It will thus be understood that there is a threshold force which must be exerted in order to dislodge the pipe 100.

It will now be further understood that a keeper with a more gradual angle on the frusto-conical portion 127 will not require as much force to dislodge a pipe 100 from it.

Hence, by providing an array of keepers with different offsets (vertical distance) between the top of the central raised portion 122 and the peripheral portion 124, an array of different force requirements would be permitted, for the dislodgement of the pipe 100.

Another means of changing the force required to dislodge the pipe 100, without changing the offset, is to decrease or enlarge the surface area of the top of the portion 122, thus increasing or restricting the contact location through which the magnetic flux lines are required to pass. It will be understood that a smaller surface at the top of the raised central portion 122 will require a smaller force to dislodge a pipe 100 from the respective keeper.

It will be realized that, by appropriately dimensioning the recess 129*a* and the opening 129*b*, the head 133 of the stem member 130 may be allowed a certain transverse freedom of movement, while still being retained within the recess 129*a*. With such an arrangement, it would be preferred to align the keeper at the bottom of each goal post in such a way that the greatest transverse freedom was parallel to the direction of a hypothetical line joining the two forward goal posts.

It will also be understood that this invention may be utilized for lacrosse, floor hockey and any other sport which utilizes net frames.

While two particular embodiments of this invention have been illustrated in the accompanying drawings and described hereinabove, it will be apparent to those skilled in the art that changes and modifications may be made therein, without departing from the essence of this invention.

I claim:

1. A cylindrical canister for use within a pipe to retain the pipe in place against a keeper, the canister comprising:

means defining a ferromagnetic flux path within the canister and adapted to contact the keeper, the flux path being defined by a ferromagnetic core within a radially polarized magnetic layer, the magnetic layer being surrounded by a ferromagnetic sleeve, and means for sustaining a closed magnetic circuit passing through the means defining said ferromagnetic flux path and the keeper.

2. The canister claimed in claim 1, in which the flux path is defined by two spaced-apart ferromagnetic members sandwiching between them a magnet polarized such that the flux lines pass from one member to the other through the magnet.

3. The canister claimed in claim 2, in which the magnet is a permanent magnet.

4. The canister claimed in claim 1, in which the flux path is defined by a cylindrical ferromagnetic core encased by a radially polarized magnetic sheath, in turn encased by a ferromagnetic sleeve.

5. The canister claimed in claim 4, in which the magnetic sheath is composed of magnet segments.

6. The canister claimed in claim 5, in which the magnetic segments are permanent ceramic magnets.

7. The canister claimed in claim 4, in which the core, the sheath and the sleeve are bonded together.

8. The canister claimed in claim 7, in combination with a keeper which has a raised central portion adapted to contact an end of the core, a lower peripheral portion adapted to contact the pipe, and a frusto-conical portion between the central and peripheral portions.

9. The canister claimed in claim 1, in combination with a keeper.

10. In combination:

a hollow hockey goal post in the form of a ferromagnetic pipe with an open bottom end, a cylindrical canister within said pipe, the canister having a solid ferromagnetic core encased by a radially polarized magnetic sheath, the latter being encased by a ferromagnetic sleeve fitting closely within the pipe, and a keeper secured to the ice, the keeper having a raised central portion adapted to contact an end of the core, a lower peripheral portion adapted to contact the ferromagnetic pipe, and a frusto-conical portion between the central and peripheral portions.

11. The combination claimed in claim 10, in which the keeper is connected to a stem adapted to be threaded into a receiving means under the surface of the ice, the stem having a head received and captive within a recess in the keeper, whereby the keeper has some freedom to angulate with respect to the stem, in order to achieve good contact with said end of the core.

12. The combination claimed in claim 10, including a plurality of said keepers, each with a different offset between the raised central portion and the lower peripheral portion, whereby to require different amounts of lateral force to dislodge the pipe from the keeper, the combination further including means for retaining the canister above a lower limit position with respect to the goal post.

13. The combination claimed in claim 12, in which the keepers are interchangeably securable to the ice of a hockey rink.

14. The combination claimed in claim 10, in which the keeper is secured to the ice of a hockey rink.

15. In combination:

a hollow hockey goal post in the form of a ferromagnetic pipe with an open bottom end, a keeper secured to the ice, the keeper having a raised central portion adapted for insertion within the open bottom end of the ferromagnetic pipe, and a frusto-conical portion surrounding the raised central portion, and a cylindrical canister within said pipe, the canister having means defining a ferromagnetic flux path within the canister and including the keeper, the canister incorporating means sustaining a closed magnetic ciruit passing through the means defining the ferromagnetic flux path within the canister, the keeper, and the ferromagnetic pipe.

* * * * *